US008408432B2

(12) United States Patent
Delamare et al.

(10) Patent No.: US 8,408,432 B2
(45) Date of Patent: Apr. 2, 2013

(54) DISPENSING CLOSURE

(75) Inventors: Sarah Delamare, Passau (DE); Daniel Gotsmich, Hinterschmiding (DE); Alexander Stifter, Freyung (DE); Franz Lenz, Hinterschmiding (DE)

(73) Assignee: Aptar Freyung GmbH, Freyung (DE)

( * ) Notice: Subject to any disclaimer, the term of this patent is extended or adjusted under 35 U.S.C. 154(b) by 0 days.

(21) Appl. No.: 13/384,565

(22) PCT Filed: Jul. 16, 2009

(86) PCT No.: PCT/EP2009/005210

§ 371 (c)(1),
(2), (4) Date: Jan. 17, 2012

(87) PCT Pub. No.: WO2011/006521

PCT Pub. Date: Jan. 20, 2011

(65) Prior Publication Data

US 2012/0111902 A1 May 10, 2012

(51) Int. Cl.
*B67D 3/00* (2006.01)

(52) U.S. Cl. ..... 222/519; 222/521; 222/549

(58) Field of Classification Search ..... 222/519–525, 222/544, 548–549, 490–491, 494, 153.14; 215/218–221, 314, 318, 216, 267
See application file for complete search history.

(56) References Cited

U.S. PATENT DOCUMENTS 705,160 A * 7/1902 Swanson ..... 222/520
850,086 A * 4/1907 Goss ..... 222/520
1,152,817 A * 9/1915 Hyatt ..... 222/520
3,484,023 A * 12/1969 Meshberg ..... 222/402.11
5,111,977 A * 5/1992 Maguire et al. ..... 222/521
5,135,139 A * 8/1992 Krawagna ..... 222/520
(Continued)

FOREIGN PATENT DOCUMENTS

DE 195 41 830 A1 5/1997
EP 0 658 482 A1 6/1995
FR 2 711 360 A1 4/1995

OTHER PUBLICATIONS

International Search Report issued during the International Phase of International Patent Application No. PCT/EP2009/005210 of which the instant application is the U.S. National Phase.

*Primary Examiner* — Frederick C. Nicolas
(74) *Attorney, Agent, or Firm* — Wood, Phillips, Katz, Clark & Mortimer

(57) ABSTRACT

The present invention relates to a dispensing closure for a container, said dispensing closure comprising: a base (200) and mounting means (200) on said base for mounting said base to a container at an opening of the container, said base also constituting an outer side-wall (240) of said closure; a dispensing element (100) having a dispensing channel (160) and a discharge opening (164) said dispensing element being movable between a closed position and an open position; said dispensing element comprising at least one operational control element (142), at least partially extending into at least one opening (242) in said outer side wall of said base to be accessible by a user in order to move said dispensing element between said closed and said open position; said dispensing closure being arranged such that said discharge opening is closed by said outer sidewall of said base, when said dispensing element is in its closed position, and/or such that said dispensing channel is closed by a shut-off element (260) of said base, when said dispensing element is in its closed position.

13 Claims, 5 Drawing Sheets

U.S. PATENT DOCUMENTS 5,197,634 A * 3/1993 Beck ..... 222/109
5,897,037 A * 4/1999 Mann ..... 222/519
6,029,866 A * 2/2000 Wood et al. ..... 222/536
6,543,652 B1 * 4/2003 Kelder et al. ..... 222/212
6,896,160 B2 * 5/2005 Kaufman et al. ..... 222/153.14
6,932,244 B2 * 8/2005 Meshberg ..... 222/153.13
8,231,032 B2 * 7/2012 Puma ..... 222/520
2004/0112927 A1 6/2004 Kaufman et al.

* cited by examiner

DISPENSING CLOSURE

FIELD OF THE INVENTION

The present invention relates to closures for containers, and more particularly to a dispensing closure having two positions, namely an open position for dispensing a fluid or a flowable medium and a closed position.

BACKGROUND OF THE INVENTION

Various designs for such closures are already known. Both documents EP 0 558 810 A1 and EP 0 658 482 A1 for example disclose a dispensing closure with a so-called "twist collar" comprising a base for being mounted to a container, an actuator carried by said base and a hinge means for mounting said actuator on said base to accommodate tilting of said actuator, while the dispensing closure also comprises a ring mounted on said base for rotation relative to said base and actuator about said central axis, while said ring and actuator together cooperatively define a can drive means for effecting said tilting of said actuator.

BRIEF SUMMARY OF THE INVENTION

It is an object of the present invention to provide an alternative or an improved closure device, being comfortable for the user when handling the device, being cost-effective during manufacturing and/or less prone to errors or malfunctions.

This object is solved by a dispensing closure for a container according to claim 1, claims 2 to 13 relate to specifically advantageous realizations of the dispensing closure according to claim 1.

The dispensing closure according to the invention comprises a base and a dispensing element. The base comprises mounting means for mounting said base to a container at an opening of said container. Furthermore, said base constitutes an outer side-wall of said closure.

The dispensing element comprises a dispensing channel and a discharge opening, and the dispensing element is movable between a closed position of said closure, typically and preferably an inner position, and an open position of said closure, typically and preferably an outer position.

Furthermore, the dispensing element comprises at least one operational control element, at least partially extending into and/or through at least one opening in said outer side-wall, so that said at least one operational control element is accessible by a user or an operator, who can e.g. grip or exert a force onto said at least one operational control element in order to move said dispensing element between said closed and said open position. The dispensing closure according to the invention is, from the construction perspective, very easy to manufacture and non-complex and therefore cheap, furthermore, it is possible to realize the dispensing closure by only two elements, the base on the one hand and the dispensing element on the other hand, thereby avoiding the necessity of multiple elements, which are interrelated, leading to complex movements. Due to this construction the dispensing closure of the element leads to low manufacturing costs on the one hand, and it is also less prone to errors or malfunctions, while at the same time providing a very save and clean functioning.

The dispensing closure is arranged such that said discharge opening is closed by said outer side-wall of said base, when said dispensing element is in its closed position, and/or such that said dispensing channel is closed by a shut-off element of said base, when said dispensing element is in its closed position.

Preferably both the discharge opening is closed by said outer side-wall of said base and the dispensing channel is closed by a shut-off element, when said dispensing element is in its closed position as this is an especially secure closing of the dispensing closure, avoiding any possible leakage of fluid or flowable medium from the container. Especially the closing or covering of the discharge opening by said outer side-wall, when said dispensing element is in its closed position, is of advantage, as it ensures that the closing or shutting-off is at the outermost position, namely at the discharge opening itself, avoiding thereby also a dripping of any possible fluid or flowable medium still contained in the dispensing channel.

In one specific embodiment a valve, preferably a slit-valve, typically made of silicone, is placed within the dispensing channel and preferably at an outer part of the dispensing channel, preferably directly inside the discharge opening. Preferably the valve does not extend beyond the dispensing channel.

Due to the fact that the dispensing element is mainly arranged within the base defining the outer side-wall of said closure, the device is very compact and accidental opening of the dispensing closure, e.g. during transport of a container with such a dispensing closure, is avoided.

The dispensing closure according to the invention is very easy to operate, and it can be operated easily with just one hand, by operating the operational control element with the fingers, while holding the container with the dispensing closure in the same hand (one-hand operation), while one-hand operation is possible both for left-handed and right-handed persons. Of course, also two-hand operation is easily possible.

The fact that only two separate elements are necessary, furthermore does not only lower manufacturing costs and lower possibility for malfunctions, but also provide easy and cost effective possibilities for colour coding. By e.g. providing each of the two elements in different colours, a clear visualization of the operating mechanism is automatically realized.

Preferably the dispensing element of the dispensing closure is substantially arranged within an area or a space defined by the outer side-wall of said base. This has the advantage that the closure can be very compact, yet being easy to operate and having an extremely low risk of being accidentally activated or opened.

In a preferred embodiment the dispensing element is arranged in the base such that the movement from the closed to the open position is a helical or screw-like movement. This helical or screw-like movement, i.e. the superposition of both a rotational movement and a longitudinal movement, provides a very comfortable operation of the closure, especially as the user can move the operational control element over a longer, effective distance, while the linear or longitudinal movement in an axial direction in order to lift e.g. the discharge opening of the dispensing element above the side-wall of said closure, is only over a shorter distance. This arrangement also lowers the risk of an accidental opening of the dispensing closure, e.g. during transport, as an only very slight movement of the operational control element does not automatically fully open the discharge opening.

Preferably the at least one operational control element is in the form of a knob, extending at least into one opening in the side-wall. This has the advantage that at least parts of the operational control element are still covered and protected by said side wall of said closure, so that the risk of accidental activation or movement of said operational control element and therefore accidental opening of the discharge opening is lowered even further.

In one preferred embodiment the operational control element, e.g. the knob, does extend only into the opening of the side wall, but it does not extend beyond the side-wall of said closure. In another embodiment the operational control panel extends beyond the outer boarders of said side-wall, so that the operational control element can be more easily gripped or activated by the user.

In a specifically preferred embodiment, the outer surface of the side-wall comprises a recess in the area around the at least one opening for said operational control element. Thereby, the two above-mentioned advantages are combined: Due to the recess the at least one operational control element is easier accessible by the user, as extending beyond the outer surface of said recess, on the other hand, the outer boarder of the side-wall beyond the recess still provides protection against an accidental movement of the operational control element.

In a preferred embodiment, there are two operational control elements, being preferably arranged, in a circumferential direction, in opposition positions, i.e. in a circumferential distance of about 180°.

This has the advantage that the two operation control elements can be easily operated, as the forces exerted by the user on both operation control panels in a radial direction neutralize each other, so that only the "rotating force" is applied to the dispensing element. This makes especially the one-hand operation very comfortable for the user.

The operation control element is preferably in the form of a knob, but also other forms can be realized, e.g. pins etc. Various forms of such knobs or pins, e.g. circumferential forms, but also rectangular forms, are possible, furthermore various structures on the outer surface of the operation control element can be realized to increase e.g. friction between the operation control element and the finger of a user, in order to enhance a comfortable and easy opening of the dispensing closure by the user. This is especially important in case of containers and dispensing closures, being typically operated by a user with wet and therefore slippery hands, as it is e.g. the case for containers containing shower gel or shampoo etc.

In a preferred embodiment the dispensing element comprises a dispensing channel, substantially radially extending from a central portion of the dispensing element to the discharge opening, being preferably positioned in an outer side-surface of the dispensing element.

The dispensing channel preferably comprises at said central portion an inlet or inlet portion, being closed by a corresponding shut-off element of said base when said dispensing element is in its closed position. This arrangement provides a very reliably closing or shutting-off of the dispensing closure, being non-complex and therefore cost-effective in manufacturing.

Furthermore, it is preferred that the discharge opening of the dispensing element is fully covered by the outer side-wall of said base respectively, so that in its closed position the discharge opening is completely covered, so that also any fluid or flowable medium, still being present in the dispensing channel, can not exit the dispensing channel when said dispensing element is in its closed position.

In a preferred embodiment the shut-off element of the base is a dome-like extension, while preferably this dome-like extension fits into an inlet or inlet portion of said dispensing channel being essentially circular in cross section. This provides an easy and very reliably shut-off of flow of the fluid or flowable medium.

Preferably the top surface of the dispensing element does not extend beyond the top edge of the outer side-wall of the dispensing closure, being constituted by said base, when said dispensing element is in its closed position. Preferably the top edge of the outer side-wall and the top surface of the dispensing element are on the same level, when the dispensing element is in its closed position, so that the top surface of the dispensing closure is essentially flat, thereby automatically ensuring that the dispensing element can not be gripped or actuated from the top side, avoiding any accidental opening of the dispensing closure.

In another embodiment, however the top edge of the outer side-wall of the base at least partly extends beyond the top, flat surface of the dispensing element, while even in its open position the top edge of the outer side-wall of the base is substantially on the same height level as the top surface of the dispensing element, in which case however a recess in the edge of the outer side-wall of the base has to be provided, while this recess has to at least partly overlap with the discharge opening of the dispensing closure, when said dispensing closure is in its open position.

In a preferred embodiment the dispensing closure additionally comprises a lock and/or a latching and/or a catch element, in order to lock and/or catch and/or restrain the dispensing element in its closed position, e.g. when the container will be transported.

BRIEF DESCRIPTION OF THE DRAWINGS

These and other features and advantages of the dispensing closure according to the present invention will be more apparent when considering the attached drawings showing preferred embodiments of the dispensing closure.

DETAILED DESCRIPTION OF THE PREFERRED EMBODIMENTS

Figure 1:
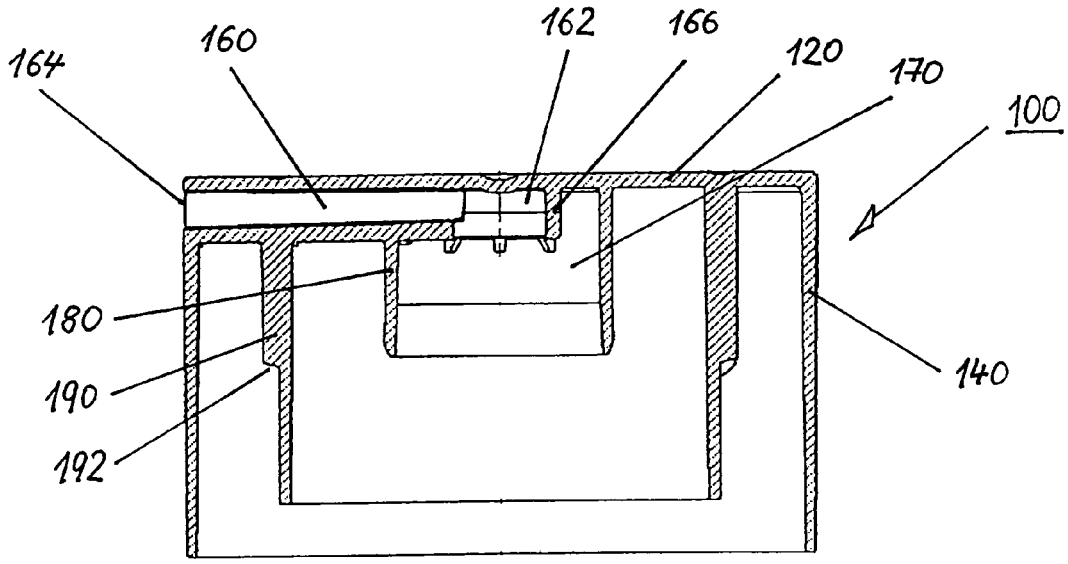
FIG. 1 is a cross-sectional view of an embodiment of a dispensing element according to the present invention, while the cross section is through the center of the dispensing element and along a dispensing channel.

FIG. 1 shows a cross-sectional view of the dispensing element 100 of a dispensing closure according to the present invention. The dispensing element 100 has an essentially circular cross section, so that the sidewalls 140 are essentially cylindrical and covered by a top surface 120.

The dispensing element 100 defines a dispensing channel 160, extending essentially radially from a central portion having an inlet 162, mainly defined by a partial cylindrical wall 166, to a discharge opening 164.

Figure 3:
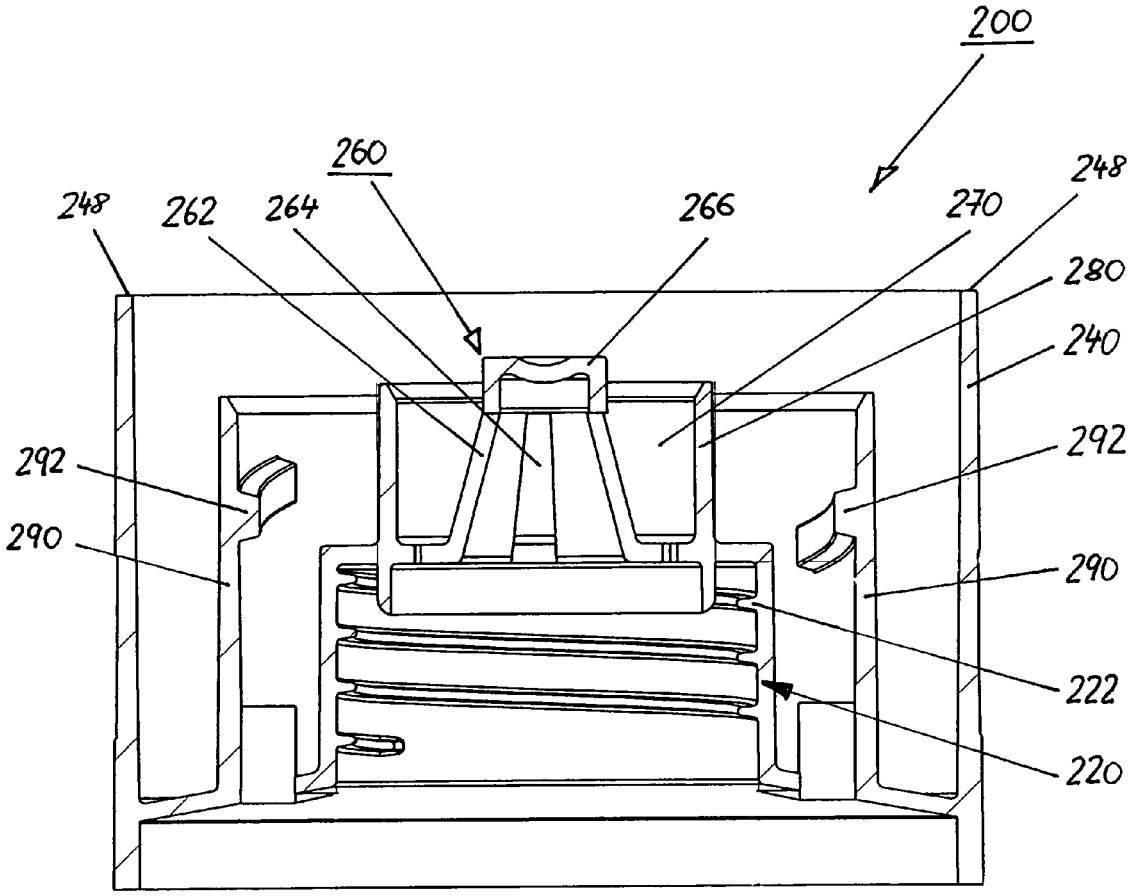
FIG. 3 is a cross-sectional view of an embodiment of a base according to the present invention.

The dispensing element 100 further comprises at its inside an essentially cylindrical inner wall 180 defining a space 170, and furthermore an essentially cylindrical wall 190, having a screw-like or helical step 192 arranged at its outer surface for interaction with a corresponding protrusion of the base (see protrusion or thread element 292 of base 200, FIG. 3).

Figure 2:
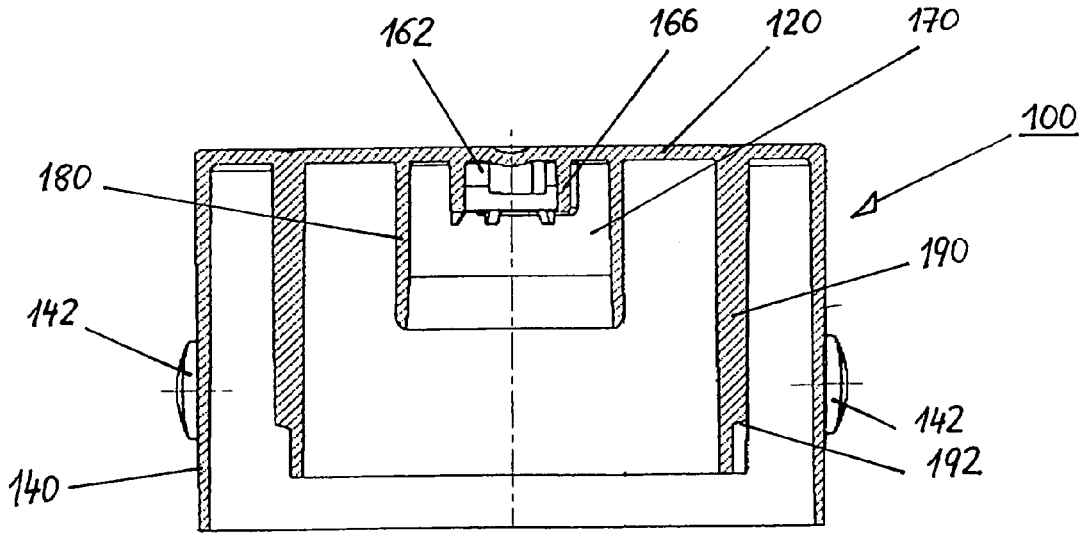
FIG. 2 is a cross-sectional view of the dispensing element as shown in FIG. 1, from a 90° different angle.

As can be seen in FIG. 2, there are two operational control elements 142 provided at the outer surface of the outer sidewall 140, while these operational control elements 142 are essentially in the form of knobs or pins, with an essentially circular cross section. These operational control elements 142 extend in corresponding openings or slits of the base (see especially FIGS. 6 and 7, slits 242 in base 200), when the dispensing element 100 is mounted into or at a corresponding base.

FIG. 3 shows a cross-section of an embodiment of a base 200 of a dispensing closure according to the present invention. The base 200 also has an essentially circular cross-section, therefore essentially cylindrical outer side-walls 240. The top side of the base 200 is open so that the corresponding dispensing element 100 (see FIGS. 1 and 2) can be inserted or mounted.

The base 200 comprises mounting means 220 for mounting said base to a container (not shown) at an opening of the container. The mounting means 220 in this embodiment do comprise a thread 222, matching with a corresponding thread of the not-shown container.

The base 200 also contains essentially cylindrical walls 290, comprising thread-elements 292 for an interrelationship or engagement with the helical step 192 of the dispensing element 100, (see FIGS. 1 and 2). The thread-elements 292 and the helical step 192 control the essentially helical or screw-like relative movement between the dispensing element 100 and the base 200 between the closed position (see FIG. 4) and the open position (see FIG. 5).

The base 200 also contains a dome-like protrusion 260 with a tapered body 262 having slits 264, which connect a space 270, being defined by the tapered body 262 and essentially cylindrical sidewalls 280 of the base 200, with an interior of the dome-like protrusion and therefore with an interior of a container to be attached to the base.

Furthermore, the dome-like protrusion 260 comprises an essentially cylindrical head 266, which fits into the inlet 162, so that said head 266, in cooperation with the partially cylindrical wall 166, closes the inlet 162 when said dispensing element is in its closed position, and therefore shuts off the dispensing channel 160 against the container.

Figure 4:
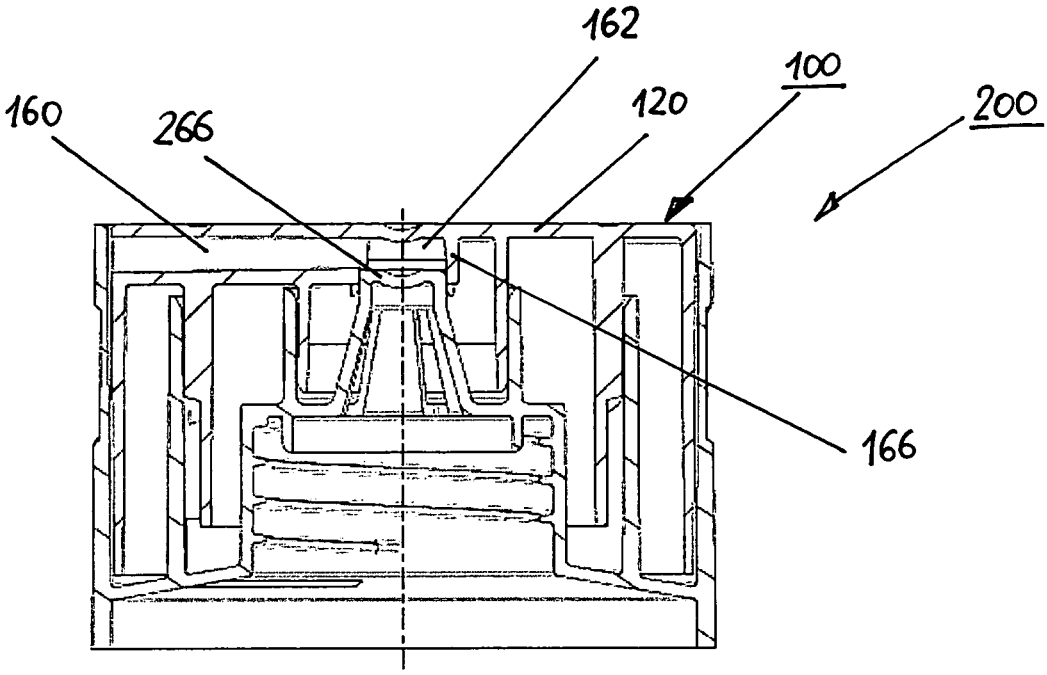
FIG. 4 is a cross-sectional view of an embodiment of a dispensing closure according to the present invention in its closed position.
Figure 5:
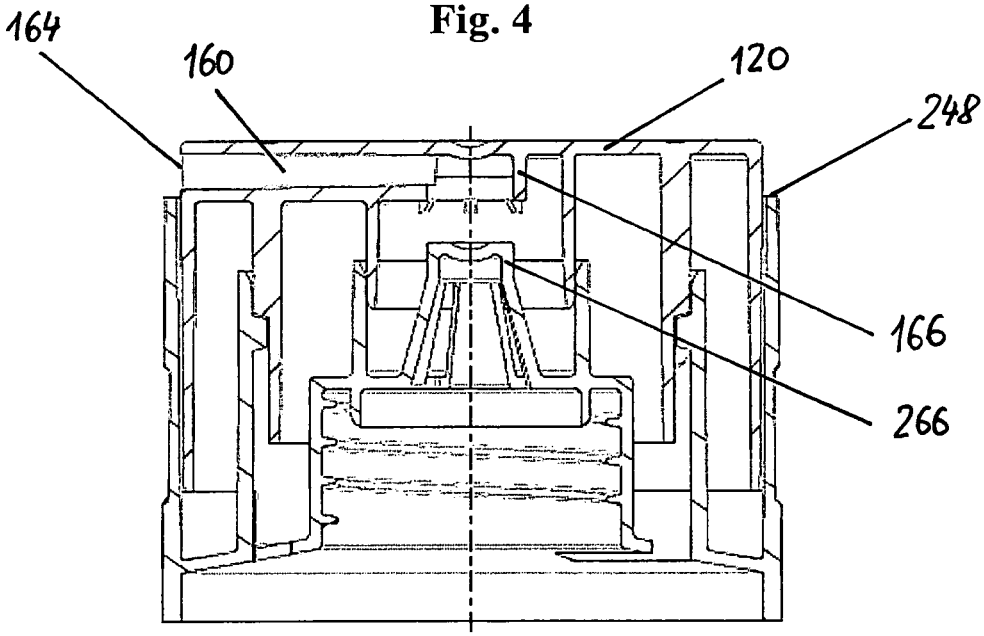
FIG. 5 is a cross-sectional view of the embodiment shown in FIG. 4 in its open position.

FIG. 4 and FIG. 5 show the dispensing element 100, as shown in FIG. 1 and FIG. 2, and the base 200, as shown in FIG. 3, in its assembled state, therefore showing a complete dispensing closure for a container according to the invention, while FIG. 4 shows the dispensing closure in its closed position and FIG. 5 shows the dispensing closure in its open position.

As can be well seen in FIG. 4, the dispensing element 100 is in its inner or lower position, i.e. in the closed position. In this position the essentially cylindrical head 266 of the dome-like protrusion 260 extends into the central portion or inlet 162, so that the inlet 162 and therefore the dispensing channel 160 is closed. Any fluid or fowable medium can therefore only enter into the interior of the dome-like protrusion 260, can enter through the slits 264 into the space 270, but cannot enter into the inlet 162 or the dispensing channel 160.

FIG. 5 shows the device in its open position, where, in comparison to FIG. 4, the base 200 has been rotated relative to the dispensing element 100, while it has to be noted that in practice of course the base 200 is fixed to the container and the user rotates in fact the dispensing element 100 (relative to his hands or the container), while typically keeping the container and the base 200 fixed in his hands. However, the dispensing element 100 has been shown in FIG. 5 in the same position as in FIG. 4, especially in order to show the dispensing channel 160. Furthermore, of course it has to be acknowledged that for the functioning of the device only the relative movement between base and dispensing element is of relevance.

As can be seen in FIG. 5, the dispensing element 100 has been also lifted or elevated by the relative rotation, so that the top surface 120 extends beyond the upper edge 248 of the outer wall 240 of the base 200. By this upward movement (relative to the base), the head 266 of the dome-like protrusion 260 is not inserted any more into the inlet 162, so that fluid or flowable medium can enter from the space 270 through the inlet 162 and can be discharged through the dispensing channel 160 and the discharge opening 164.

FIGS. 4 and 5 also very well show the interaction between the partial thread or thread element 292 of the base 200 and the helical step 192 of the wall 190 of the dispensing element 100, controlling the movement of the dispensing element 100 within the base 200.

Figure 6:
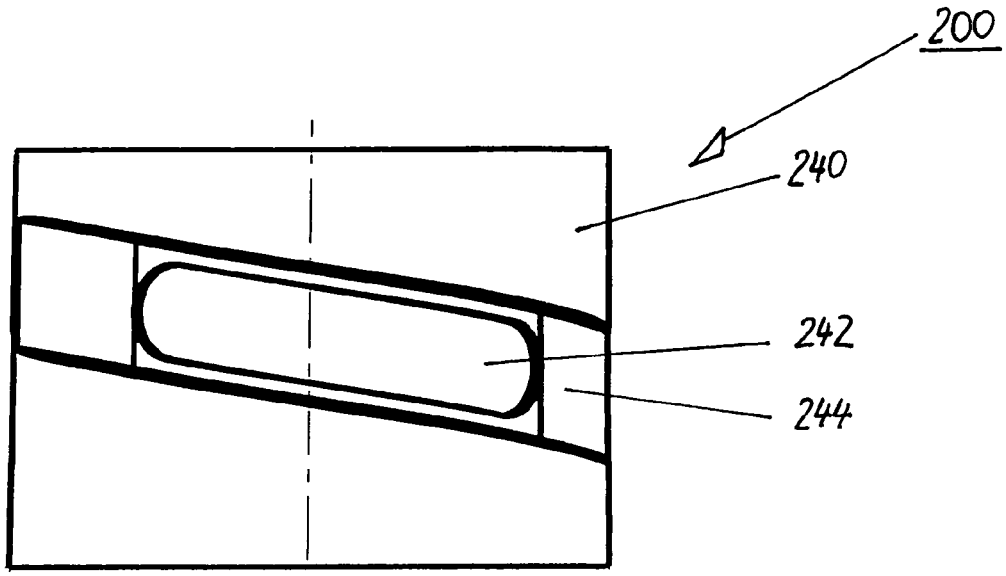
FIG. 6 is a sideview of a base as shown in FIGS. 1 and 2.
Figure 7:
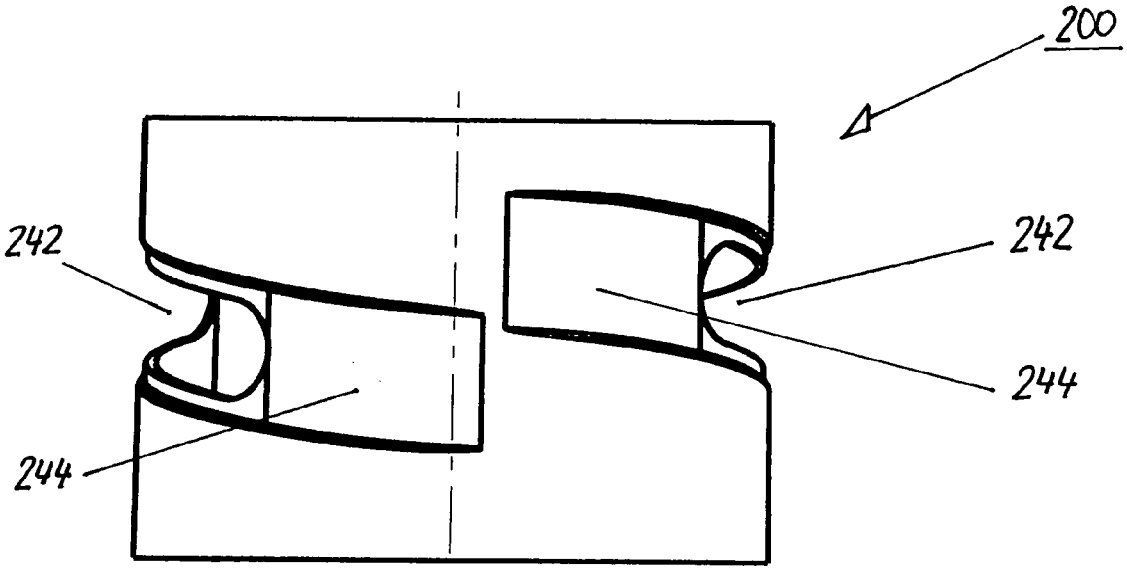
FIG. 7 shows another sideview as FIG. 6, from a 90° different angle.

FIGS. 6 and 7 show sideviews of the base 200 with the outer sidewall 240, see also FIG. 3 and the description to FIG. 3 above.

FIGS. 6 and 7 also show two openings 242, being in the form of slits, into each of which or through each of which an operation control element (see 142 in FIG. 2) can extend. The openings or slits 242 are inclined such that the dispensing element 100 (see FIGS. 1 and 2) will be moved in a helical or a screw-like manner between its closed and its open position when each or both of said operation control elements 142 (see FIG. 2) are moved or activated by the user.

As can be especially well seen in FIG. 7, the openings or slits 242 are arranged in a recess area 244, while the corresponding operation control elements 142 (see FIG. 2) have such a radial extension that the operation control elements 142 extend beyond the surface directly around the opening 242, such that these operation control elements extend beyond the outer surface of the recess 244, but do not or hardly extend beyond the outer surface of the outer side wall 240.

The depth of the recesses 244 is essentially identical over the complete longitudinal extension of the opening 242 and is in the area of about 1 mm, while in the areas beyond the opening 242, the depth of the recess is continuously decreasing to zero, therefore continuously moving into the sidewall 240. Of course, in another embodiment it is also possible to provide recesses with an identical singular depth over the complete extension of the recesses 244.

The openings or slits 242 are arranged at opposite sides in a circumferential direction such that essentially a rotation of the dispensing element by 90° is possible, however, also other slits or opening lengths are possible.

Furthermore, the slits 242 are arranged such that by moving the dispensing element from its closed position to its opened position, the top surface 120, (see FIGS. 1 and 2), of the dispensing element will be elevated by about 4 mm. Of course also other arrangements with respect to the elevation are possible and depend on the specific embodiment and size of the dispensing closure.

Figure 8:
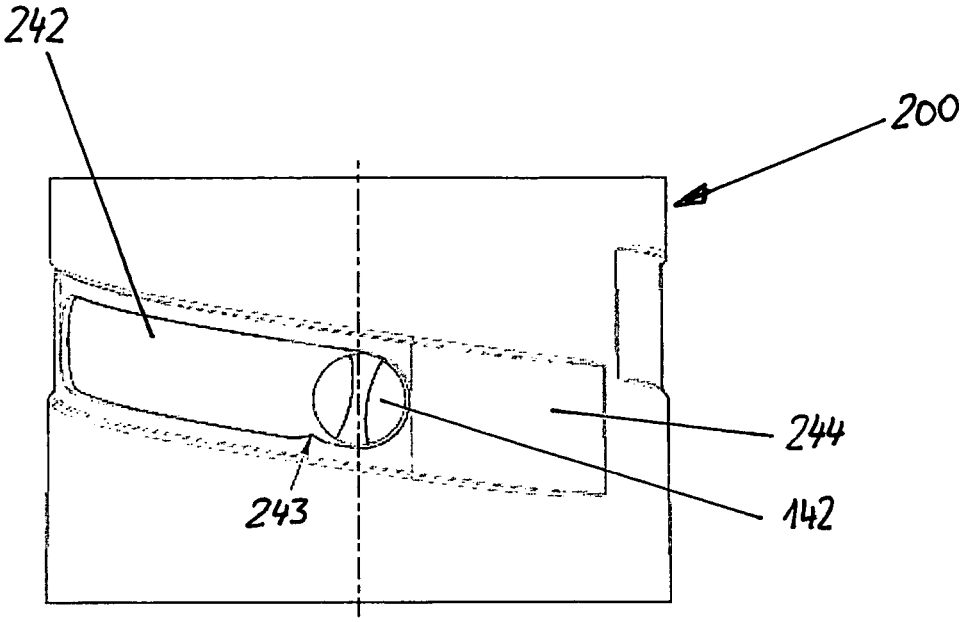
FIG. 8 shows a sideview of another embodiment of the dispensing closure in its closed position.
Figure 9:
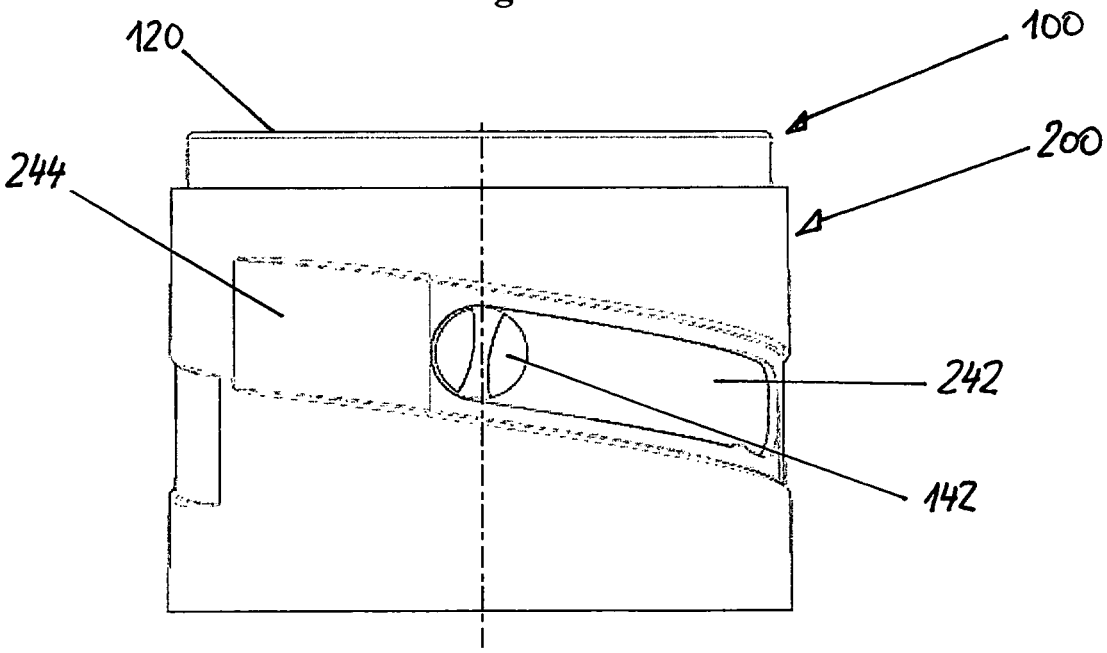
FIG. 9 shows the embodiment of FIG. 8 in its open position.

FIGS. 8 and 9 show a sideview of another embodiment of a dispensing closure according to the invention, while FIG. 8 shows the device in its closed position and FIG. 9 shows the device in its open position.

The dispensing closure shown in FIGS. 8 and 9 is essentially identical to the embodiment shown in FIGS. 1 to 7, the same or similar elements are therefore designated by the same reference numerals, and it is referred to the above description, in order to avoid repetitions.

In this embodiment the openings or slits 242 have, at its lower edge, a protrusion 243, serving as latching means. As can be specially seen in FIG. 8, a higher force is necessary to move the operational control element 12 beyond this protrusion 243, so that an accidential "opening" of the device, e.g. during transport, is avoided.

FIG. 9 also very well shows the dispensing element 100 with its top surface 120 being raised above the upper edge 248 of the side wall 240 of the base 200.

The features disclosed in the foregoing description, in the claims and/or in the accompanying drawings may, both separately and in any combination thereof, be material for realising the invention in diverse forms thereof.

What is claimed is:

1. A dispensing closure for a container, said dispensing closure comprising:

a base (200) and mounting means (220) on said base (200) for mounting said base (200) to a container at an opening of the container, said base (200) also constituting an outer side-wall (240) of said closure, said outer side-wall (240) defining at least one opening (242) extending completely through said side-wall (240);

a dispensing element (100) having a dispensing channel (160) and a discharge opening (164), said dispensing element (100) being movable between a closed position and an open position;

said dispensing element (100) comprising at least one operational control element (142), at least partially extending into said at least one opening (242) in said outer side wall (240) of said base (200) to be accessible by an operator such that a force can be exerted by the operator onto said at least one operational control element in order to move said dispensing element (100) between said closed and said open position;

said dispensing closure being arranged such that said discharge opening (164) is closed by said outer side-wall (240) of said base (200), when said dispensing element (100) is in said closed position, and/or such that said dispensing channel (160) is closed by a shut-off element (260) of said base (200), when said dispensing element (100) is in said closed position.

2. A dispensing closure according to claim 1, wherein said discharge opening is at least partly not closed by said outer side-wall (240) of said base (200), when said dispensing element (100) is in said open position.

3. A dispensing closure according to claim 1, wherein the dispensing element (100) is arranged substantially in an area defined by the outer side-wall (240) of said base (200).

4. A dispensing closure according to claim 1, wherein said base (200) and said dispensing element (100) are arranged such that the movement of the dispensing element (100), relative to the base (200), between said closed and said open position is essentially helical.

5. A dispensing closure according to claim 1, wherein said at least one operational control element (142) is in the form of a knob.

6. A dispensing closure according to claim 1, wherein said at least one opening (242) in said base (200) is in the form of a slit.

7. A dispensing closure according to claim 1, wherein two operational control elements (142) are provided at said dispensing element (100).

8. A dispensing closure according to claim 1, wherein said outer side wall (240) of said base (200) has a recess (244) at said outer side and in the area around the at least one opening (242) for said operational control element (142).

9. A dispensing closure according to claim 1, wherein said dispensing element (100) comprises a dispensing channel (160), substantially radially extending from a central portion (162) of the dispensing element (100) to the discharge opening (164).

10. A dispensing closure according to claim 1, wherein said dispensing channel (60) comprises at said central portion an inlet (162), being closed by said shut-off element (260) of said base (200) when said dispensing element (100) is in said closed position.

11. A dispensing closure according to claim 9, wherein said shut-off element (260) is in the form of an essentially dome-like extension.

12. A dispensing closure according to claim 1, wherein a top surface (120) of said dispensing element (100) does not extend beyond a top edge (248) of the outer side-wall (240), when said dispensing element (100) is in said closed position.

13. A dispensing closure according to claim 1, wherein an additional lock or a catch mechanism is provided for locking and/or catching the dispensing element (100) in said closed position.

* * * * *